US008814549B2

(12) United States Patent
Solty

(10) Patent No.: US 8,814,549 B2
(45) **Date of Patent: *Aug. 26, 2014**

(54) POWDER PRESS

(71) Applicant: SMS Meer GmbH, Moenchengladbach (DE)

(72) Inventor: Walter Solty, Hueckelhoven (DE)

(73) Assignee: SMS Meer GmbH, Moenchengladbach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/934,359

(22) Filed: Jul. 3, 2013

(65) Prior Publication Data

US 2014/0010904 A1 Jan. 9, 2014

(30) Foreign Application Priority Data

Jul. 4, 2012 (DE) ..... 10 2012 013 227

(51) Int. Cl.
*B30B 7/00* (2006.01)
*B30B 11/04* (2006.01)
*B30B 15/04* (2006.01)

(52) U.S. Cl.
CPC . *B30B 7/00* (2013.01); *B30B 11/04* (2013.01); *B30B 15/045* (2013.01)
USPC ..... 425/78; 72/456

(58) Field of Classification Search
CPC ..... B22F 3/03; B30B 11/02; B30B 15/041; F18B 15/1471
USPC ..... 425/78; 72/456
See application file for complete search history.

(56) References Cited

U.S. PATENT DOCUMENTS

| | | | |
|---|---|---|---|
| 4,260,346 | A | 4/1981 | Anderson, Jr. et al. |
| 5,218,901 | A | 6/1993 | Imanishi |
| 7,803,294 | B2 | 9/2010 | Pannewitz et al. |
| 2004/0208948 | A1 | 10/2004 | Lee |
| 2008/0145466 | A1 | 6/2008 | Beane |

FOREIGN PATENT DOCUMENTS

| | | | |
|---|---|---|---|
| DE | 2 224 592 | A1 | 12/1972 |
| DE | 119 745 | A1 | 5/1976 |
| DE | 30 36 533 | A1 | 4/1981 |
| DE | 41 28 895 | A1 | 3/1992 |

(Continued)

OTHER PUBLICATIONS

German Office Action dated Mar. 7, 2013 in German Patent Application No. 10 2012 013 227.1 with English translation of the relevant parts.

(Continued)

*Primary Examiner* — Jacob Thomas Minskey
(74) *Attorney, Agent, or Firm* — Collard & Roe, P.C.

(57) ABSTRACT

A powder press has an upper yoke, a lower yoke, and a tension element that is in effect between the upper yoke and the lower yoke, as well as a die accommodation plate that is guided along the tension elements. The plate can be displaced parallel to the tension element, via a punch that supports itself on the upper yoke or the lower yoke, or to which pressure can be applied. The punch accommodates a die plate provided on an adapter and includes at least a cylinder and/or a piston disposed in the cylinder, to which hydraulic pressure can be applied in the cylinder. The powder press has a particularly compact construction if the cylinder and/or the piston surrounds a passage opening through the die accommodation plate or through the upper or lower yoke and/or a tension element.

11 Claims, 3 Drawing Sheets

(56) References Cited

FOREIGN PATENT DOCUMENTS

| | | | |
|---|---|---|---|
| DE | 43 07 107 | C1 | 9/1994 |
| DE | 44 25 565 | A1 | 2/1996 |
| DE | 10 2005 035 920 | A1 | 3/2006 |
| DE | 10 2005 027 296 | B3 | 11/2006 |
| DE | 10 2005 052 158 | A1 | 5/2007 |
| EP | 0 053 187 | A1 | 6/1982 |
| EP | 0 224 096 | A2 | 6/1987 |
| EP | 1 952 975 | A1 | 8/2008 |
| EP | 2 095 933 | A2 | 9/2009 |
| GB | 1 398 611 | A | 6/1975 |
| JP | 2007-100131 | A | 4/2007 |
| JP | 2009-291799 | A | 12/2009 |
| KR | 10-2011-0127780 | A | 11/2011 |
| RU | 1 771 880 | A1 | 10/1992 |
| WO | WO 2012/089198 | A1 | 7/2012 |

OTHER PUBLICATIONS

German Office Action dated Mar. 8, 2013 in German Patent Application No. 10 2012 013 229.8 with English translation of the relevant parts.

International Search Report of PCT/DE2011/002187, mailed Jun. 1, 2012.

Austrian Search Report dated Jan. 22, 2014 in Austrian Application No. A 551/2013 with English translation of relevant parts.

Austrian Search Report dated Jan. 21, 2014 in Austrian Application No. A 550/2013 with English translation of relevant parts.

200
6
1
2
3
4
8
9
10
21
22
23
III
IV
VI

POWDER PRESS

CROSS REFERENCE TO RELATED APPLICATIONS

Applicant claims priority under 35 U.S.C. §119 of German Application No. 10 2012 013 227.1 filed Jul. 4, 2012, the disclosure of which is incorporated by reference.

BACKGROUND OF THE INVENTION

1. Field of the Invention

The invention relates to a powder press having an upper yoke, a lower yoke, and a tension element that is in effect between the upper yoke and the lower yoke, as well as having a die accommodation plate that is guided along the tension elements, which plate can be displaced parallel to the tension elements, via a punch that supports itself on the upper yoke or the lower yoke, or to which pressure can be applied, and which accommodates a die plate provided on an adapter, whereby the punch comprises at least a cylinder and/or a piston disposed in the cylinder, to which hydraulic pressure can be applied in the cylinder.

2. Description of the Related Art

Such powder presses are known, for example, from the still unpublished document PCT/DE2011/002187, whereby it is understood that the corresponding punch can also be supported indirectly on the upper yoke or on the lower yoke, in that it is supported on further modules connected with these yokes in locally fixed manner. DE 10 2005 027 296 B3 and US 2004/02089488 also disclose such powder presses comprising an adapter. DE 10 2005 035 920 A1 also discloses a similar arrangement, whereby here, there is no lower yoke and no die or die accommodation plate that can be displaced separately relative to the former.

SUMMARY OF THE INVENTION

It is an object of the present invention to structure a powder press of the stated type in more compact manner.

These and other objects are achieved by a powder press according to the invention.

In this connection, the powder press having an upper yoke, a lower yoke, and a tension element that is in effect between the upper yoke and the lower yoke, as well as having a die accommodation plate that is guided along the tension elements, which plate can be displaced parallel to the tension element, via a punch that supports itself on the upper yoke or the lower yoke, or to which pressure can be applied, and which accommodates a die plate provided on an adapter, whereby the punch comprises at least a cylinder and/or a piston disposed in the cylinder, to which hydraulic pressure can be applied in the cylinder, is characterized in that the cylinder and/or the piston surrounds a passage opening through the die accommodation plate or through the upper or lower yoke and/or a tension element.

In this way, the powder press has a smaller construction, because significantly less space is required for the pistons or cylinders, if these pistons or cylinders surround a passage opening and/or a tension element. In particular, if the powder press is suitably configured, more construction space can also be guaranteed for the adapter, along with easier accessibility to the adapter or to the construction space within the tension elements.

Preferably, the adapter in turn includes a head plate that is in effect on the head side of the die plate, a foot plate that is in effect on the foot side of the die plate, and a guide for the die plate that is in effect between the head plate and the foot plate. In this way, the adapter, as a design unit that is closed in itself, guarantees guidance of the die plate, and, if applicable, of further additional plates or secondary plates, in stable and reliable manner, even during pressing.

The powder press has a particularly compact construction if the tension element forms an inner wall of the space provided in the cylinder, to which hydraulic pressure is to be applied. In this manner, it is possible to do without a separate module in this regard. In this connection, it is understood that the latter can be implemented in simple manner accordingly, particularly in the case of tension elements configured in tube-like or rod-like manner. If, alternatively, more complex tension elements, such as cable systems or the like, are used, separate modules for making the cylinder wall available can also be used in this regard.

Preferably, the cylinder is disposed on the upper yoke or on the lower yoke, so that hydraulic guidance toward moving parts, particularly toward the die accommodation plate, is not necessary.

Cumulatively or alternatively, it is advantageous if the cylinder opens toward the bottom. In this way, the risk can be minimized that powder, the distribution of which fundamentally cannot be completely avoided in the surroundings of the powder press, will collect in the gap or the seal between cylinder and piston and have a wearing or otherwise damaging effect there. On the other hand, it is understood that a cylinder disposed underneath the die plate, in particular, can also open toward the top, in other words be provided on the lower yoke, because less powder can be expected in this region, and, if applicable, the advantages of a cylinder disposed on the lower yoke, which have already been explained above, predominate.

The unit composed of cylinder and piston, of which at least one surrounds a passage opening through the die accommodation plate or through the upper or lower yoke and/or a tension element, or the punch structurally implemented by means of this unit, can be easily controlled, on the one hand, as a lower punch or, on the other hand, as an upper punch. In particular, it is possible to divide up the known lower punch into two units of cylinder and piston, of which one unit, namely the lifting unit, is disposed below the die accommodation plate, and one unit, namely the lowering unit, is disposed above the die accommodation plate. Likewise, the total unit can be controlled, for example, simply as a lower punch. On the other hand, it is just as easily possible to divide an upper punch accordingly, and to control the two units of cylinder and piston as an upper punch, accordingly. Likewise, however, this configuration ultimately makes it possible to implement a combination of upper punch and lower punch by means of the cylinders or pistons that surround the passage opening and/or the tension element. Ultimately, these possibilities are only a question of the dimensioning and control of the cylinders, in each instance.

The division into two of a corresponding punch, into cylinders and pistons disposed above and below the die accommodation plate, allows a smaller amount of oil overall, via a suitable differential control system. The division furthermore leads to a combination of the function of an upper punch and a lower punch that has not been implemented previously, which ultimately can be controlled no longer separately but together. In this way, the powder press furthermore has a significantly more compact construction.

Accordingly, the punch, in other words an upper punch and/or a lower punch, for example, advantageously includes at least two cylinders and two pistons, of which one cylinder and one piston are disposed above the die accommodation plate, and one cylinder and one piston are disposed below the die accommodation plate.

Preferably, the punch has at least two cylinders and two pistons, which are disposed symmetrically with regard to a center axis of the die accommodation plate, in each instance. In this manner, the forces can be applied to the die accommodation plate particularly uniformly, so that the risk of tilting can be minimized. On the other hand, it is understood that a unilateral or asymmetrical configuration is also possible, particularly at low stresses, for which a corresponding punch is provided.

Depending on the concrete implementation, not all the punches have to act directly on the die accommodation plate; this case arises, in particular, if the pistons are directly connected with the die accommodation plate. This situation, however, does not have to apply to all punches, so that an upper punch can be centrally provided, as before, which punch acts centrally, in other words on a die or die plate, and thereby can act on the related die accommodation plate merely indirectly.

It is understood that the characteristics of the solutions described above or in the claims can also be combined, in order to be able to implement the advantages cumulatively, accordingly.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF PREFERRED EMBODIMENTS

Figures 3, 4, 5, 6:
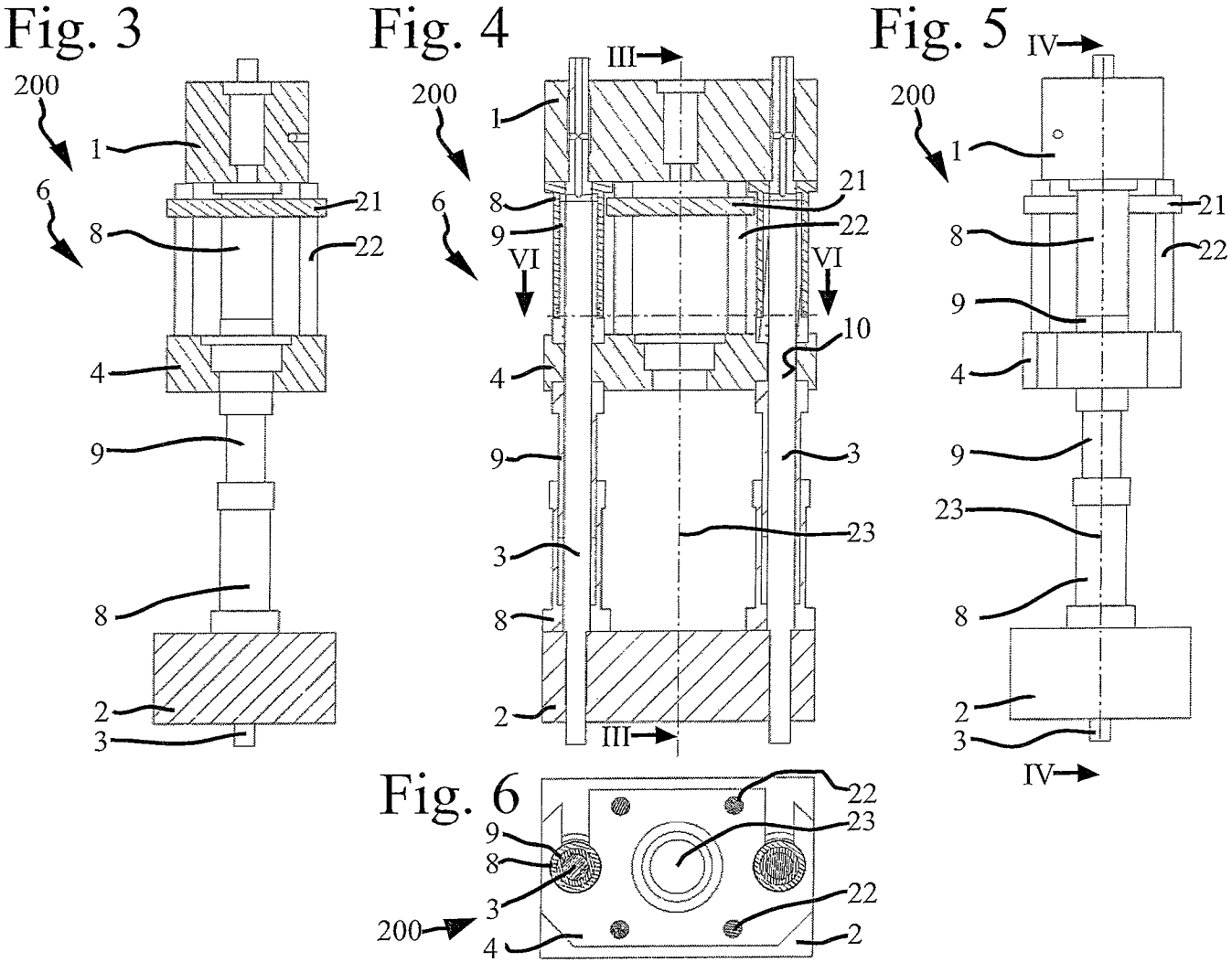
FIG. 3 is a schematic cross-section along the line in FIG. 4 through a second embodiment of a powder press.
FIG. 4 is a section similar to FIG. 1 along the line IV-IV in FIG. 5 through the powder press according to FIG. 3.
FIG. 5 is a side view of the powder press according to FIGS. 3 and 4.
FIG. 6 is a section along the line VI-VI in FIG. 4 through the arrangement according to FIGS. 3 to 5.

Turning now in detail to the drawings, the powder presses 100 and 200 (see, e.g., FIGS. 1 and 3) comprise an upper yoke 1 and a lower yoke 2, in each instance, between which tension elements 3 are provided, whereby the powder press 100 has four tension elements and the powder press 200 (see FIGS. 3 to 6) has two tension elements 3. A die accommodation plate 4 is mounted to be axially displaceable along the tension elements 3, whereby this plate can be displaced parallel to the tension elements 3 by means of two punches that support themselves on the upper yoke 1 and the lower yoke 2, respectively, or to which pressure can be applied.

In this connection, the die accommodation plate 4 carries a die plate 7 (shown only in FIG. 1), which in turn forms the die for powder pressing or carries a corresponding die.

Although only the die plate 7 is part of the adapter 6 in the case of the powder press 100 (FIGS. 1 and 2), the die accommodation plate 4 is also part of the adapter 6 in the case of the powder press 200 (FIGS. 3 to 6).

Figure 1:
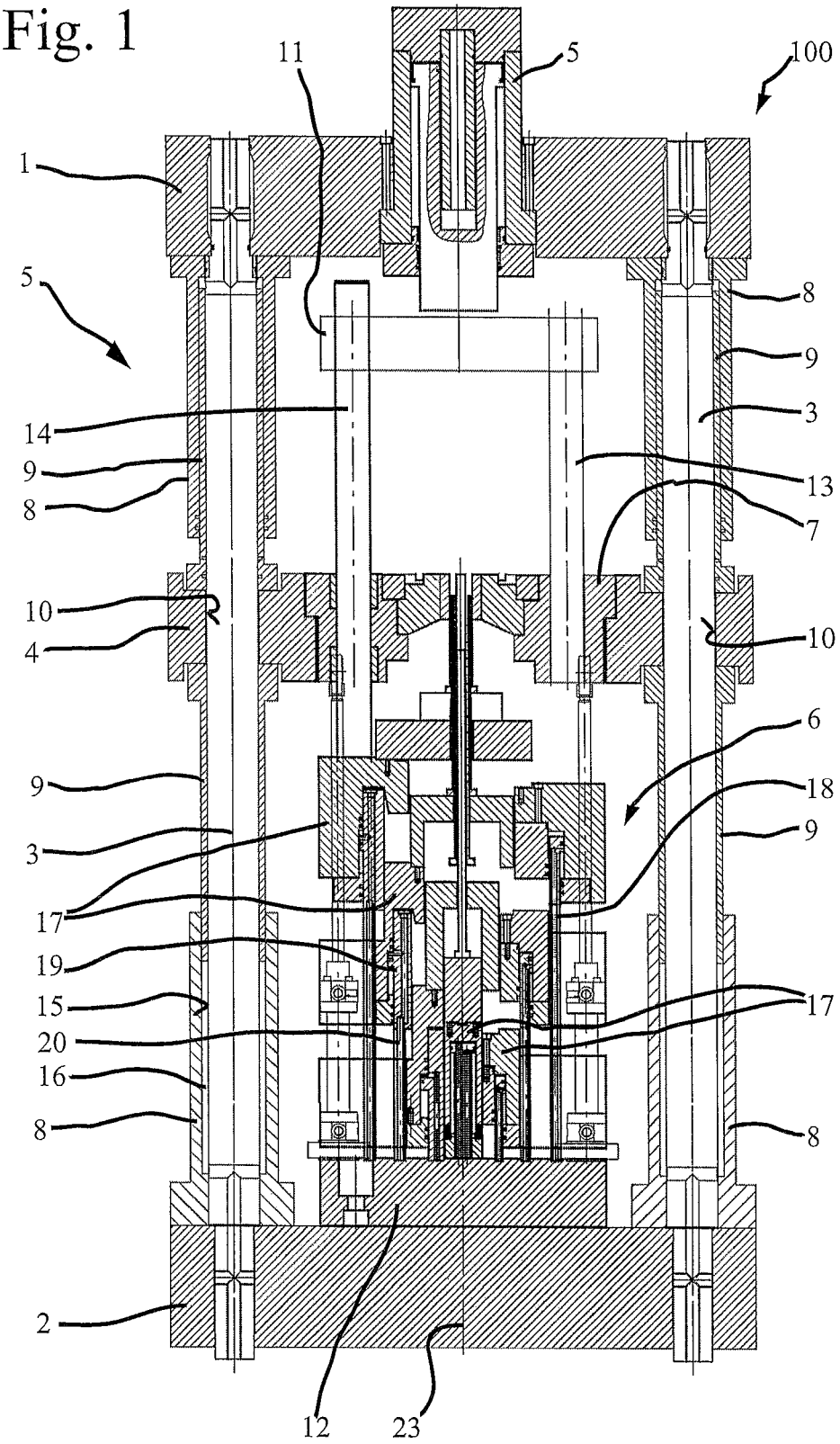
FIG. 1 is a schematic section through a first embodiment of a powder press with adapter.
Figure 2:
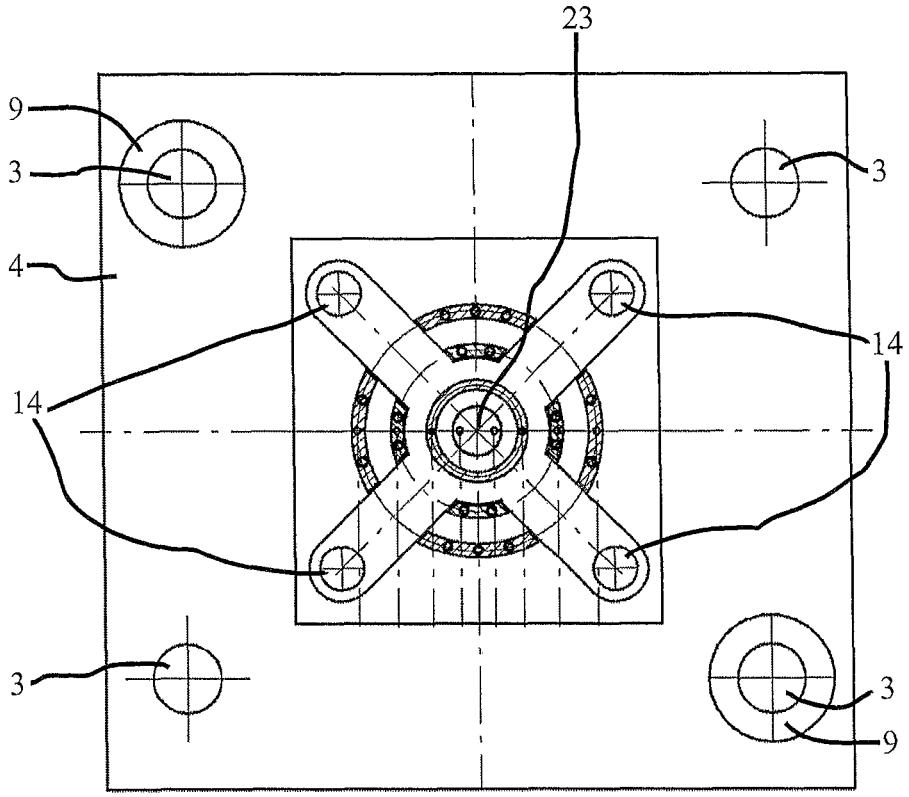
FIG. 2 is a schematic top view of the die accommodation plate and die plate of the arrangement according to FIG. 1.

In the case of the powder press 100 shown in FIGS. 1 and 2, the adapter 6 in turn comprises a head plate 11 that is in effect on the head side of the die plate 7, a foot plate 12 that is in effect on the foot side of the die plate 7, and a guide 13 for the die plate 7 that is in effect between the head plate 11 and the foot plate 12. In this manner, the adapter 6, closed in itself, is guided in extremely stable manner, and can provide stable guidance, particularly also for additional plates 17 disposed underneath the die plate 7, and also secure them with regard to a center axis 23. In this connection, the guide 13 comprises four guide rods 14, in this exemplary embodiment, which are disposed with rotation symmetry or mirror symmetry around the center axis 23. This symmetry furthermore also corresponds to the arrangement of the tension elements 3.

The powder press 200 according to FIGS. 3 to 6, on the other hand, has four guide rods on the die accommodation plate 4, which form a punch plate guide 22 for a punch plate 21. In this manner, an upper punch, not shown, can exert pressure on the punch plate 21 or move it axially downward, in order to implement the pressing process. As is particularly evident from FIG. 6, the arrangement of die accommodation plate 4, punch plate 21, and punch plate guide 22 can be taken out of the powder press 200 as an adapter 6.

Both presses have a punch 5 that serves as a lower punch and a punch 5 that serves as an upper punch (shown only in FIG. 1), whereby in these exemplary embodiments, the lower punch 5 is configured in multiple parts and has two cylinders 8 disposed on the lower yoke 2 and two cylinders 8 disposed on the upper yoke 1, in each instance, in which related pistons 9 are disposed, in each instance, which can act on the die accommodation plate 4. As is directly evident in FIGS. 2 and 6, these cylinders 8 and pistons 9 are oriented symmetrically with regard to the center axis 23, so that the risk of tilting is reduced to a minimum.

In this connection, in the case of the powder press 100 shown in FIGS. 1 and 2, two tension elements 3 still remain (see FIG. 2), which are not surrounded by cylinders 8 or pistons 9, so that if necessary, the upper punch 5 can also be disposed around these tension elements 3 or around passage openings there, accordingly.

In this manner, even more space remains for possible maintenance activities, particularly for replacing the adapter 6.

Furthermore, the pistons 9 surround a passage opening 10 through the die accommodation plate 4, while the cylinders 8 surround a passage opening (not numbered separately) through the upper or lower yoke 1, 2, in each instance.

In the two exemplary embodiments, the tension element 3 forms an inner wall 15 of the space 16 provided in the cylinder 8, to which hydraulic pressure is to be applied, and this arrangement is accordingly space-saving and therefore leads to a compact powder press 100, 200.

As is directly evident, the cylinders 8 disposed on the upper yoke 1 open toward the bottom, so that the risk that powder gets into the gap or the seal between cylinder 8 and piston 9 is reduced to a minimum. In contrast, in the two exemplary embodiments, the cylinders 8 disposed on the lower yoke 2 open toward the top, which ultimately does not appear to be critical, because there the risk of powder flying about is significantly lower. The latter has the advantage that even in this arrangement, the cylinder 8 can be filled with hydraulic fluid, seen from the lower yoke, so that complex arrangements in this regard do not appear to be necessary.

In the present exemplary embodiments, the units of cylinders 8 and pistons 9 are controlled as a lower punch, in each instance. As was already indicated above, implementation as an upper punch is also easily possible, particularly if the head plate 11 in the powder press 100 is structured to be movable, similar to the punch plate 21 of the powder press 200. In this way, a corresponding press pressure can be exerted by the upper punch by way of this plate 11, 21, for which purpose the plates 11, 21 can preferably surround the tension elements 3, similar to the die accommodation plate 4, for example.

For the sake of completeness it should still be explained that in the powder press 100, the additional plates 17 are configured as lower plates, as an example, and are provided, by way of cylinder/piston units 18, with cylinders 19 that face downward, provided on the additional plates 17, and with pistons 20 that face upward and ensure the hydraulic supply, so that the cylinders 19 serve for additional plate guidance, on the one hand, and, on the other hand, assembly and disassembly can be simplified by means of the fact that they open downward.

Although only a few embodiments of the present invention have been shown and described, it will be apparent that many changes and modifications may be made thereunto without departing from the spirit and scope of the invention.

What is claimed is:

1. A powder press comprising:

(a) an upper yoke;

(b) a lower yoke;

(c) a plurality of tension elements in effect between the upper yoke and the lower yoke;

(d) a punch on the upper yoke or on the lower yoke, said punch being self-supporting or subjected to pressure and comprising at least one of a cylinder and a piston disposed in a cylinder, wherein hydraulic pressure is applied in the cylinder;

(e) an adapter;

(f) a die plate provided on the adapter and accommodated by the punch;

(g) a die accommodation plate guided along the tension elements and displaceable parallel to the tension elements, the cylinder or the cylinder and the piston acting on the die accommodation plate; and at least one of (h) and (i):

(h) a passage opening surrounded by at least one of the cylinder and the piston, said passage opening extending through the die accommodation plate or the upper yoke or the lower yoke; and (i) a tension element of the plurality of tension elements being surrounded by at least one of the cylinder and the piston.

2. The powder press according to claim 1, wherein the adapter comprises a head plate that is in effect on a head side of the die plate, a foot plate that is in effect on a foot side of the die plate, and a guide for the die plate that is in effect between the head plate and the foot plate.

3. The powder press according to claim 1, wherein a tension element of the plurality of tension elements forms an inner wall of a space provided in the cylinder where hydraulic pressure is to be applied.

4. The powder press according to claim 1, wherein the cylinder is disposed on the upper yoke or on the lower yoke.

5. The powder press according to claim 1, wherein the cylinder opens downward.

6. The powder press according to claim 1, wherein the punch is controlled as a lower punch.

7. The powder press according to claim 1, wherein the punch is controlled as an upper punch.

8. The powder press according to claim 1, wherein the punch comprises at least first and second cylinders and first and second pistons, wherein the first cylinder and the first piston are disposed above the die accommodation plate and the second cylinder and the second piston are disposed below the die accommodation plate.

9. The powder press according to claim 1, wherein the punch has at least first and second cylinders and first and second pistons respectively disposed symmetrically with regard to a center axis of the die accommodation plate.

10. The powder press according to claim 1, wherein the punch acts on the die accommodation plate directly.

11. The powder press according to claim 1, wherein the punch acts on the die accommodation plate indirectly by way of a die.

* * * * *